US005485979A

United States Patent [19]

LaPointe et al.

[11] Patent Number: 5,485,979

[45] Date of Patent: Jan. 23, 1996

[54] CHAIR BASE

[75] Inventors: Larry P. LaPointe, Temperance; Jonathan R. Saul, LaSalle; Karl J. Komorowski, Petersburg, all of Mich.

[73] Assignee: La-Z-Boy Chair Company, Monroe, Mich.

[21] Appl. No.: 180,889

[22] Filed: Jan. 12, 1994

[51] Int. Cl.[6] ..... F16M 11/24

[52] U.S. Cl. ..... 248/188.2; 248/346.03; 248/372.1; 297/DIG. 7

[58] Field of Search ..... 248/678, 127, 248/143, 151, 188.1, 188.2, 188.7, 371, 372.1, 396, 357, 501, 502, 346; 297/440.22, 440.1, 85, DIG. 7; 5/201, 200.1, 207, 282.1; 211/191, 192

[56] References Cited

U.S. PATENT DOCUMENTS

| | | | |
|---|---|---|---|
| 2,780,431 | 2/1957 | Carlson | 248/188.1 |
| 3,096,121 | 7/1963 | Knabusch et al. . | |
| 3,106,297 | 10/1963 | Schroeder | 211/192 |
| 3,510,010 | 5/1970 | Gasner | 211/192 |
| 3,537,747 | 11/1970 | Rogers, Jr. . | |
| 3,869,169 | 3/1975 | Johnson et al. . | |
| 3,869,170 | 3/1975 | James et al. . | |
| 3,874,724 | 4/1975 | Ré . | |
| 3,904,240 | 9/1975 | Rogers, Jr. et al. . | |
| 4,071,275 | 1/1978 | Rogers, Jr. . | |
| 4,072,342 | 2/1978 | Johnson et al. . | |
| 4,108,491 | 8/1978 | Rogers, Jr. . | |
| 4,179,157 | 12/1979 | Shoemaker et al. . | |
| 4,212,494 | 7/1980 | Dabney . | |
| 4,226,469 | 10/1980 | Rogers, Jr. et al. . | |
| 4,350,387 | 9/1982 | Rogers, Jr. . | |
| 4,352,523 | 10/1982 | Holobaugh, Jr. . | |
| 4,367,895 | 1/1983 | Pacitti et al. . | |
| 4,406,374 | 9/1983 | Yedor | 211/192 |
| 4,430,763 | 2/1984 | Whitehead | 5/200.1 |
| 4,569,451 | 2/1986 | Parrott et al. | 211/191 |
| 4,570,995 | 2/1986 | Rogers, Jr. . | |
| 4,740,031 | 4/1988 | Rogers, Jr. . | |
| 5,180,068 | 1/1993 | Vargo | 211/191 |

FOREIGN PATENT DOCUMENTS

| | | | |
|---|---|---|---|
| 6403806 | 10/1965 | Netherlands | 211/191 |

*Primary Examiner*—J. Franklin Foss
*Assistant Examiner*—Korie H. Chan
*Attorney, Agent, or Firm*—Harness, Dickey & Pierce

[57] ABSTRACT

The present invention provides a non-wooden base assembly for use in articles of furniture and, more particularly, in platform-type motion chairs. In a preferred form, each of the distinct rail components, which when assembled define the base assembly, is fabricated from a rigid and durable non-wooden material. An additional object of the present invention involves the ability to quickly and simply assembly front and rear cross rail components between the laterally-spaced side rail components for modular assembly of the non-wooden base assembly. Finally, means are provided for permitting precise fixation of the front and rear cross rail components to the side rail components.

22 Claims, 5 Drawing Sheets

CHAIR BASE

BACKGROUND OF THE INVENTION

The present invention relates generally to articles of furniture and, more particularly, to chairs having an upholstered chair frame supported from a stationary base assembly.

As is well known, motion-type articles of furniture, such as reclining chairs and rocking chairs, have an upholstered chair frame supported for movement from a stationary platform or base assembly. For example, most platform-type rocking chairs generally include an upholstered chair frame which is supported for fore and aft rocking movement on a wooden base assembly.

Traditionally, conventional base assemblies have been fabricated from a pair of wooden side rails that are interconnected by a pair of transversely oriented wooden cross rails to form a rigid box-like platform structure. Prior to such assembly, the wooden rail components are cut to size and pre-drilled for providing a series of mounting apertures for the subsequent assembly thereof. The wooden rail components are typically assembled utilizing a combination of dowel pins, adhesives and fasteners to ensure proper alignment and structural rigidity. As such, secondary clamping operations are commonly employed during assembly of the wooden base assembly to align the components and accommodate complete curing of the adhesive. As will be appreciated, the parallelism and squareness of the laterally-spaced wooden side rails, as well as the length dimension of the wooden cross rails, must be precise for ultimately providing proper alignment and balancing of the moveable chair frame on the wooden base assembly.

While conventional wooden base assemblies have performed satisfactorily for their intended purpose, the ever increasing cost and lack of availability of high quality hardwood materials is a major concern for furniture manufacturers. Moreover, in an effort to deproliferate the number of independent chair frames and base assemblies currently produced for various models of chairs, furniture manufacturers have begun utilizing modular frame components and assembly techniques which can be used for assembling "universal" chair frames and base assemblies for use in motion-type chairs. However, the process limitations associated with assembling wooden frame structures have severely limited the application of the above-noted modularity concepts thereto. To this end, the need exists to develop alternatives to wooden base assemblies which overcome the noted disadvantages and concomitantly provide improved strength, smoother balanced chair motion and which utilize modular frame components that can be precisely located and secured during assembly.

SUMMARY OF THE INVENTION

Accordingly, it is an object of the present invention to provide a non-wooden base assembly for use in articles of furniture and, more particularly, in platform-type motion chairs. In a preferred form, each of the distinct rail components, which when assembled define the base assembly, is fabricated from a rigid and durable non-wooden material. One such material that has been found to be satisfactory for fabrication of the non-wooden rail components for the base assembly of the present invention is hot-rolled AISI 1 01 0 steel.

As a related object, the non-wooden base assembly provides a platform surface that exhibits a self-lubricating characteristic for promoting smoother and quieter movement of the chair frame relative thereto.

An additional object of the present invention involves the ability to quickly and simply assemble front and rear cross rail components between the laterally-spaced side rail components for modular assembly of the non-wooden base assembly. The present invention further include means for permitting precise fixation of the front and rear cross rail components to the side rail components.

Further objects, advantages and novel features of the present invention will be apparent from the following description, reference being made to the accompanying drawings wherein a preferred embodiment of the present invention is clearly shown.

DESCRIPTION OF THE PREFERRED EMBODIMENTS

Figure 1:
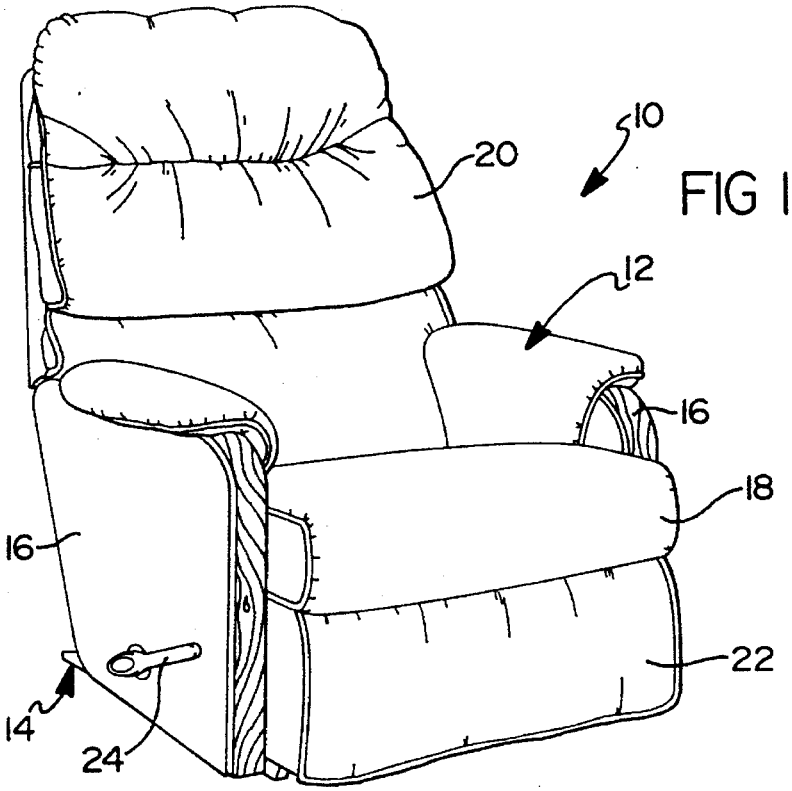
FIG. 1 is a pictorial view of an exemplary platform rocking chair incorporating the novel features of the present invention.
Figure 2:
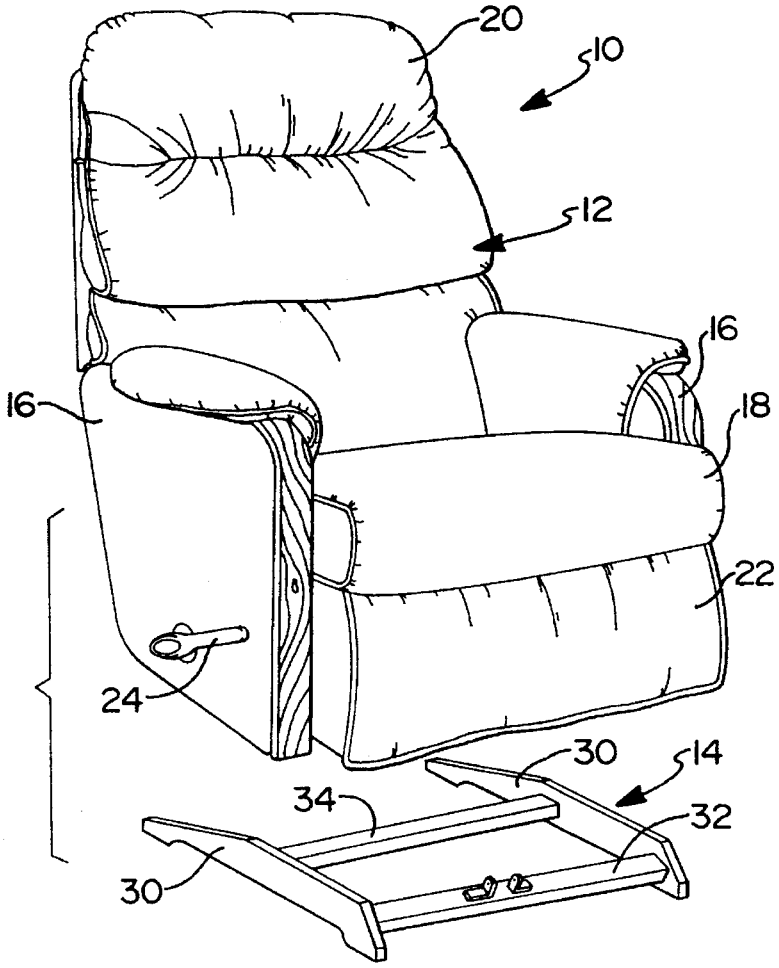
FIG. 2 is an exploded pictorial view of FIG. 1 showing the upholstered chair frame disconnected from the non-wooden base assembly of the present invention.

With reference to the drawings, and particularly to FIGS. 1 and 2, an exemplary platform-type rocking chair 10 is shown to include an upholstered chair frame 12 that is supported for rocking movement from a stationary platform-type base assembly 14. Upholstered chair frame 12 includes a pair of side frame members 16 which are interconnected in a conventional manner to provide a rigid box-like chair frame 12. A cushioned seat member 18 and a cushioned seatback member 20 are supported between side frame members 16 to define a seat assembly. The seat assembly may be fixed with respect to chair frame 12 or may be supported therefrom for reclining movement via a suitable reclining mechanism. In addition, rocking chair 10 is also shown to include an extensible leg rest assembly 22 that can be moved between the retracted or "stowed" position shown and an extended or "operative" position in response to manual actuation of a suitable drive mechanism, such as by handle 24.

In general, the present invention is directed to the utilization of a non-wooden base assembly 14 that can be easily manufactured and assembled as a modular unit for overcoming the above-noted and other shortcomings associated with traditional wooden base assemblies. As is clearly shown, base assembly 14 is comprised of a pair of laterally-spaced side rail components 30 that are securely fixed to a front cross rail component 32 and a rear cross-rail component 34, each of which extend transversely thereto. Each of the above-noted rail components is preferably formed (i.e., stamped) from sheet stock or blanks of a suitable metallic material such as, for example without limitation, hot-rolled AISI 1010 CQ steel. However, the term "metallic" is intended to define any classification of ferrous material(s) which can be formed in a stamping or pressing operation in a highly-precise and repetitive manner. As will be appreciated, the gauge (thickness) of the metallic material as well as its formability and structural characteristics (i.e., yield, tensile, hardness and the like) will be selected to provide the requisite rigidity for base assembly 14. While the rail components are hereinafter disclosed as being fabricated from metal, it is to be understood that any non-wooden material possessing the requisite strength, rigidity and load-bearing characteristic can be used.

Another feature associated with non-wooden base assembly 14 of the present invention is the incorporation of a socket-type alignment and locking arrangement for permitting precise alignment of the rail components during assembly while concomitantly facilitating a reduction in the number of fasteners required to secure the rail components together. As will be described, the above-noted socket-type alignment and locking arrangement includes the use of locking tabs formed on one of the side rail components 30 or cross rail components 32 and 34 that are receivable within receptor slots formed in the other thereof for mechanically interconnecting the rail components while concurrently aligning mounting bores formed therein for the subsequent installation of a suitable fastener.

According to a preferred construction of platform-type rocking chair 10, non-wooden rocker blocks 36 are incorporated into a spring-type rocking mechanism 38 for overcoming the shortcomings associated with otherwise conventional rocker blocks made from wood. To this end, rocker blocks 36 are preferably fabricated from a non-wooden material such as, for example, a plastic material. More preferably, plastic materials that have been found to be suitable for rocker blocks 36 are nylon or a fiberglass-filled nylon composition. Thus, while rocker blocks 36 are hereinafter referred to generally as being fabricated from "plastic", it is to be understood that virtually any non-wooden material possessing the requisite strength, rigidity and load-bearing and lubricity characteristics can be used. Moreover, the term "plastic" is also intended to define any classification of material(s) which can be formed in a molding operation in a highly-precise and repetitive manner. A detailed disclosure of a preferred construction for plastic rocker blocks 36 can be found in commonly owned U.S. Ser. No. 08/068,057 filed May 17, 1993 in the name of Jon S. Saul, et al. and entitled "Rocker Block". Similarly, a preferred construction for spring-type rocker mechanism 38 is disclosed in commonly owned U.S. Pat. No. 5,171,000 issued Dec. 15, 1992 in the name of Larry P. LaPointe, et al. and entitled "Adjustable Rocker Spring Apparatus".

Figure 3:
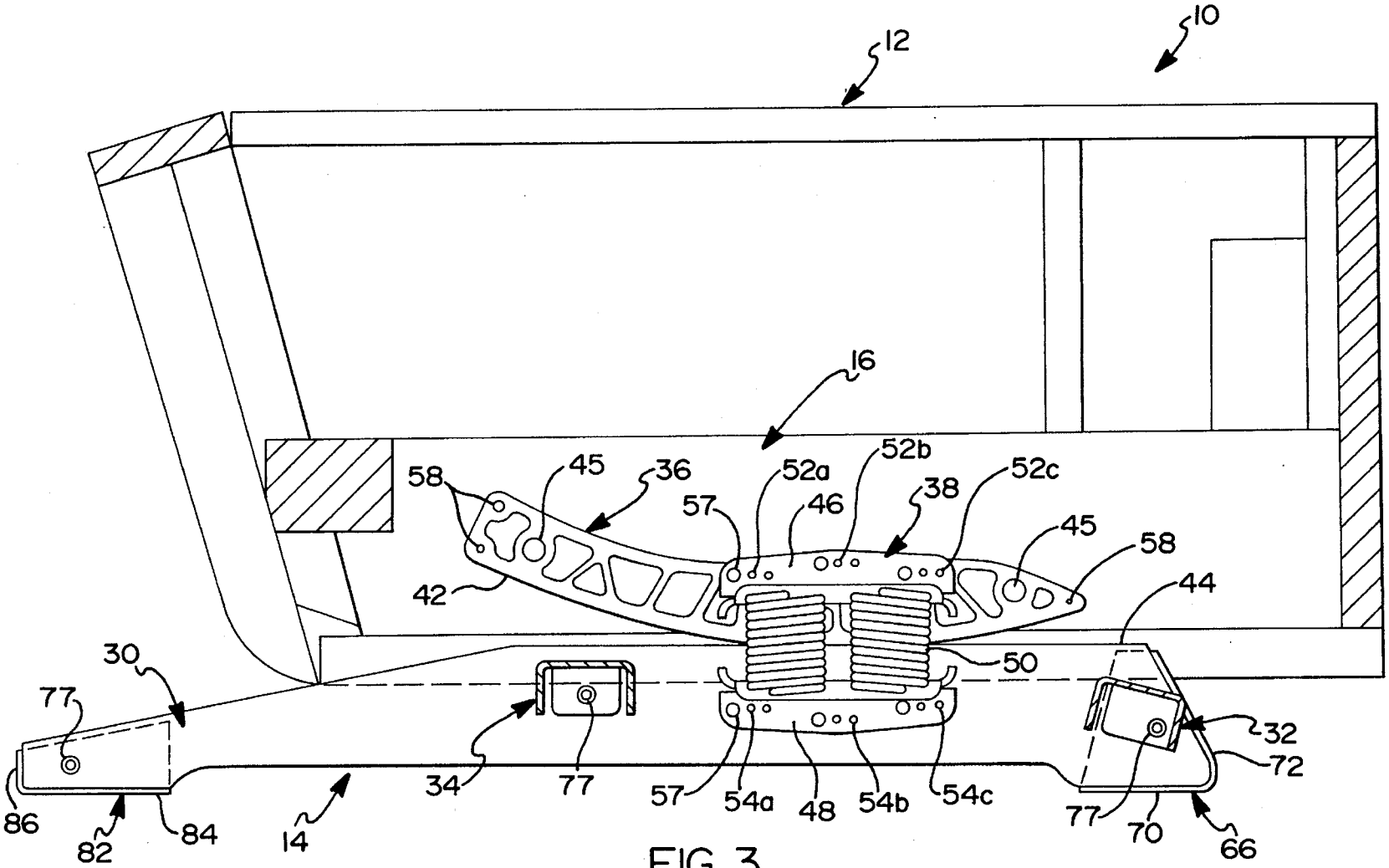
FIG. 3 is a sectional side view of a portion of the rocking chair shown in FIG. 1 illustrating a rocker mechanism operably supporting the chair frame for rocking movement relative to the stationary non-wooden base assembly of the present invention.

With particular reference now to FIGS. 3, one lateral side of chair frame 12 and non-wooden base assembly 14 are shown. However, it will be appreciated that a rocker block 36 and rocking mechanism 38 are provided at each lateral edge of chair 10 to support chair frame 12 for rocking movement relative to stationary base assembly 14. As seen, plastic rocker block 36 is fixed to a lower frame portion 40 of side frame member 16 and includes an arcuate contact or "rocking" surface 42 which is seated for rolling movement on a planar surface 44 of a lateral side rail component 30 of platform base 14. Rocker block 36 is preferably fixed to side frame member 16 without adhesives by utilizing a dowelling arrangement and suitable threaded fasteners which extend through a series of alignable apertures and bores formed in lower frame portion 40 and rocker block 36. Rocker block 36 is of a universal design for fixation to either of the left or right side frame members 16. More particularly, rocker block 36 includes two pair of integral dowel pins 45 with one pair thereof extending from each lateral surface thereof. Accordingly, each set of dowel pins 45 is adapted to extend into a corresponding set of pre-drilled alignment bores (not shown) that are formed in lower frame portion 40 of each side frame member 16. As will be appreciated, the particular molded structure of rocker block 36 is developed to provide the requisite strength, rigidity and load-bearing capacity while concomitantly reducing its overall weight and material costs. In addition, due to the self-lubricating characteristics associated with the plastic material (i.e., greater lubricity compared to wood), a low friction rolling engagement is established between arcuate rocking surface 36 and planar metallic surface 44 of side rail components 30 for effectively reducing the propagation of noise while promoting smoother rocking movement.

To provide means for controlling the rocking movement of chair frame 12 on base assembly 14, a rocker mechanism 38 couples a rocker block 36 to each lateral side rail component 30. Rocker spring mechanism 38 includes an upper bracket 46, a lower bracket 48 and a plurality of coil spring 50 disposed therebetween. As noted, rocker spring mechanism 38 is preferably similar to the apparatus disclosed in commonly owned U.S. Pat. No. 5,171,000, the disclosure of which is expressly incorporated by reference herein. As seen from FIG. 3, upper bracket 46 includes three sets of mounting apertures **52*a*, 52*b* and 52*c* which are adapted to permit adjustable alignment with respect to corresponding bores (not shown) formed in rocker block 36. Similarly, lower bracket 48 includes three sets of mounting apertures 54*a*, 54*b* and 54*c* which are likewise adapted to permit adjustable alignment with respect to bores 56*a*, 56*b* and 56*c* (FIG. 4) formed in each lateral side rail component 30 of platform base assembly 14. As clearly detailed in the above-noted patent, rocker spring mechanism 38 is adapted to be adjustably secured with conventional fasteners, such as threaded fasteners 57, to rocker block 36 and side rail component 30** in a manner facilitating its use with virtually any rocking-type chair frame and platform-type base combination.

To provide means for fixing rocker blocks 36 to side frame members 16 of chair frame 12, a series of bores 58 are formed to extend through each rocker block 36 for alignment with pre-drilled mounting apertures (not shown) that are formed in lower frame portion 40. As will be appreciated, such alignment of bores 58 with the pre-drilled apertures is accomplished upon insertion of one set of dowel pins 45 into their corresponding alignment holes in lower frame portion 40. Preferably, threaded fasteners are driven through the pre-drilled mounting apertures in lower frame portion 40 and into bores 58 to rigidly fix each rocker block 36 to its respective side frame member 16.

Figure 4:
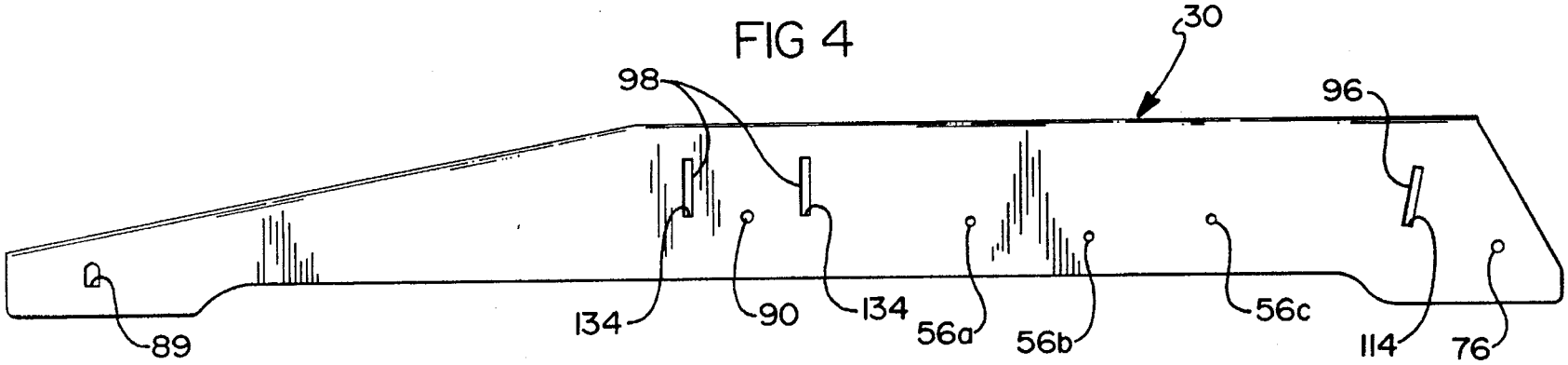
FIG. 4 is a side view of one of the side rail components of the non-wooden base assembly illustrating means for precisely aligning and securing the front and rear cross rail components and the rocker mechanism thereto.
Figure 5:
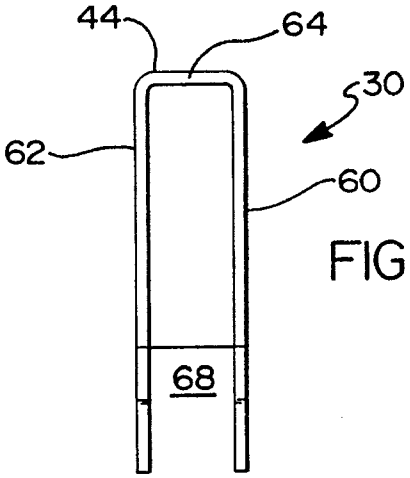
FIG. 5 is an end view of FIG. 4.

With reference now to FIGS. 3 through 10, the novel and non-obvious features associated with non-wooden base assembly 14 will now be described in greater detail. In particular, FIGS. 4 and 5 show side rail component 30 as an elongated, generally U-shaped member having an exterior leg 60, an interior leg 62 and an upper web portion 64 interconnecting legs 60 and 62. The laterally-spaced side rail components 30 shown in FIG. 2 are mirror-imaged and are preferably stamped or pressed from a continuous sheet stock or blanks of a suitable metallic material in a progressive die arrangement. Moreover, the external surface of web portion 64 defines planar surface 44 on which arcuate surface 42 of rocker block 36 rests. A front glide 66 (FIG. 3) is fitted within the forwardmost portion of an open channel 68 defined between legs 60 and 62 and extends outwardly therefrom to define pad surfaces 70 and 72 for enclosing the forward end of each side rail component 30. As will be appreciated, lower pad surface 70 is adapted for engagement with a floor surface. Preferably, front glide 66 is made from a plastic material such as, for example without limitation, nylon or polypropylene. Front glide 66 includes a bore (not shown), formed in the side wall portion thereof that is located adjacent interior leg 62 when installed within channel 68, which is adapted for alignment with a front bore 76 formed through interior leg 62 of side rail component 30. As will be further detailed, following assembly of front cross rail 32, a suitable fastener, such as threaded fastener 77, is driven through a bore 78 formed in each end portion 80 of front cross rail 32, front bore 76 in interior leg 62 of each side rail component 30 and the bore in each front glide 66 to secure the components together in a rigid fashion.

Similarly, a rear glide 82 is fitted within open channel 68 at the rearward end portion of each side rail component 30 for enclosing the same and defining pad surfaces 84 and 86. Again, pad surface 84 is adapted for engagement with a floor surface. Furthermore, it is preferable that rear glide 82 be fabricated (molded) from the same material used in fabricating front glide 66. Rear glide 82 includes a bore (not shown), formed in its sidewall portion located adjacent to interior leg 62 when installed within open channel 68, and which is alignable with a rear bore 89 formed through interior leg 62. As will be appreciated, a suitable fastener is driven through the aligned bore in rear glide 82 and rear bore 89 in interior leg 62 for fixedly securing rear glide 82 to each side rail component 30.

With continued reference to FIGS. 4 and 5, side rail component 30 is shown to further include a front receptor slot 96 and a pair of rear receptor slots 98 formed through interior leg 62 in addition to bores 56*a*, 56*b* and 56*c*. As noted, bores 56*a*, 56*b* and 56*c* are provided to permit lower bracket 48 of each rocker spring mechanism 38 to be mounted to interior leg 62 of each side rail component 30. Front receptor slot 96 is oriented and sized to receive a locking tab 100 formed on each end of front cross rail 32 for concomitantly causing precise alignment of bore 78 formed in end portion 80 of front cross rail 32 with respect to front bore 76 in interior leg 62 of side rail component 30. Similarly, each pair of rear receptor slots 98 is sized and oriented to receive a corresponding pair of locking tabs 102 formed on each end of rear cross rail component 34 for concomitantly causing precise alignment of a bore 92 formed in end segment 94 of rear cross rail component 34 with a bore 90 formed between the pair of rear receptor slots 98 in interior leg 62 of side rail component 30. Upon assembly of rear cross rail 34, a suitable fastener 77 is driven through bore 92 formed in end segment 94 and bore 90 in interior leg 62 for securing rear cross rail component 34 to side rail components 30. Thus, upon assembly of base assembly 14, locking tabs 100 and 102 will be retained within open channel 68 of side rail component 30 such that exterior leg 60 provides a clean, uninterrupted surface which is highly desireable for cosmetic purposes.

Figure 6:
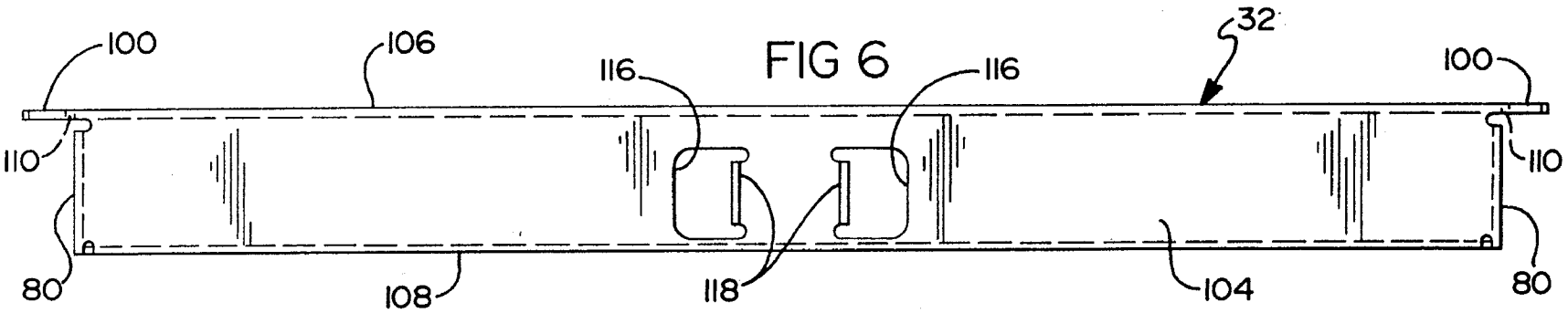
FIG. 6 is a plan view of the front cross rail component associated with the non-wooden base assembly of the present invention.
Figure 7:
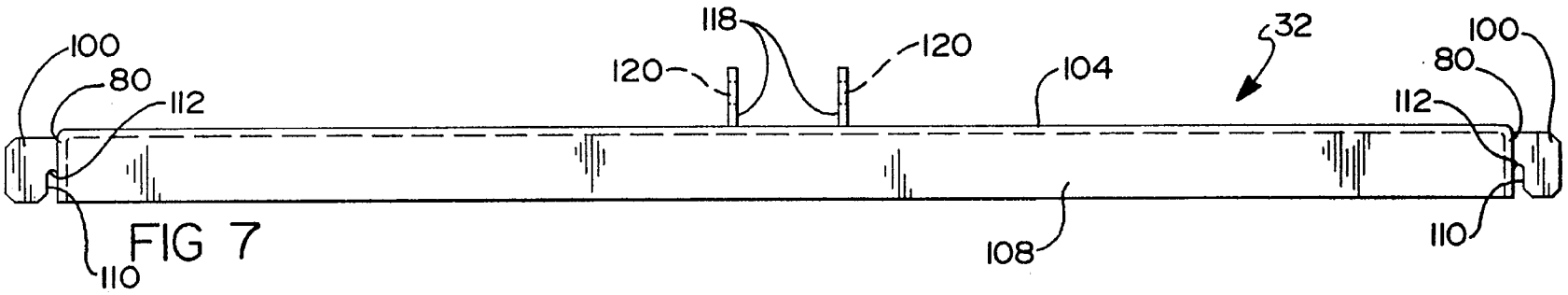
FIG. 7 is a side view of FIG. 6.
Figure 8:
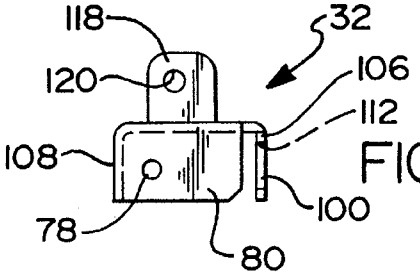
FIG. 8 is an end view of FIG. 7.

FIGS. 6 through 8 illustrate a preferred construction for front cross rail component 32. Front cross rail component 32 is also preferably stamped or pressed from a continuous sheet stock or blank of a metallic material and, more preferably, is stamped in a progressive die arrangement to facilitate highly precise, repetitive dimensional accuracy and tolerance control. Front cross rail component 32 is elongated and generally rectangular in shape and includes an upper planar segment 104, a front downturned flange segment 106, a rear downturned flange segment 108, and a pair of downturned end segments 80 in which bores 78 are formed. Each of flange segments 104 and 106 and end segments 80 are formed to be orthogonally oriented relative to each adjacent flange or end segment for defining the open-channelled box-like structure shown. While not required, the adjacent edge segments between each flange segment 104 and 106 and end segments 80 could be welded to further reinforce or rigidify the structure. As seen, locking tabs 100 project outwardly from and are coplanar with front downturned flange segment 106. In addition, each locking tab 100 is recessed to define a locking channel 110 relative to an exterior surface of each end segment 80.

Following complete insertion of each locking tab 100 into a corresponding one of front receptor slots 96 formed in the laterally-spaced side rail components 30, front cross rail component 32 is subsequently pushed down such that locking channel 110 snugly surrounds the opposite faces of interior leg 62 of side rail components 30 with locking tabs 100 retained within open channel 68. In this manner, front cross rail component 32 is mechanically locked to each side rail component 30 with its end segments 80 positioned in abutting, or near abutting, engagement with the outer surface of interior leg 62 such that each bore 78 formed in end segments 80 are aligned with front bores 76 in each side rail component 30 for subsequent receipt of threaded fastener 77. As noted previously, a front glide 66 is preassembled into open channel 68 of each side rail component 30 such that its bore is aligned with bores 78 and 76 for securing all three components with one fastener on each side thereof. To ensure precise alignment of mounting bore 78 formed in end segments 80 of front cross rail component 32 with bores 76 in side rail components 30, stop means is provided in association with locking channels 110 and is formed adjacent locking tabs 100. More specifically, the length of each locking channel 110 can be selected to provide a stop surface 112 which will abut a lower edge surface 114 of front receptor slot 96 upon front cross rail component 32 being pushed down following insertion of each locking tab 100 into its corresponding front receptor slot 96. Such engagement will provide means for precisely aligning the bores for subsequent receipt of fasteners 77.

A pair of symmetrical cut-outs 116 are formed in upper planar segment 104 of front cross rail component 32 and which define a pair of upstanding flange brackets 118. Flange brackets 118 has a set of aligned bores 120 formed therein for receipt of a pivotable ratchet member (not shown) associated with a locking arrangement for mechanically locking chair frame 12 in a rearwardly rocked or tilted position, if desired. An example of a suitable locking arrangement is shown and disclosed in commonly owned U.S. Ser. No. 07/826,691, entitled "Pawl And Rachet Assembly" which was filed on Jan. 31, 1992. However, provisions for cut-outs 116 and flange brackets 118 are optional and not required in all seating applications.

Figure 9:
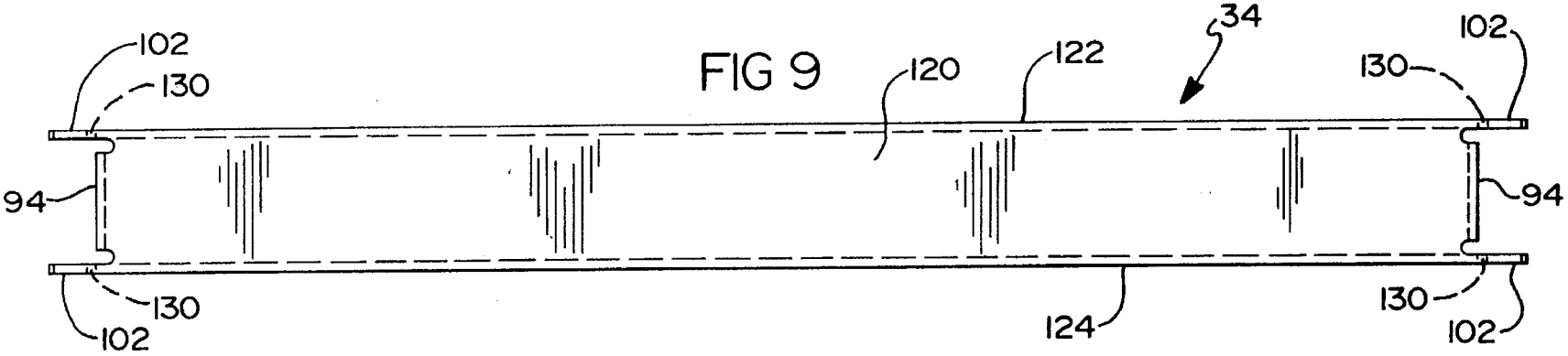
FIG. 9 is a plan view of the rear cross rail component associated with the non-wooden base assembly of the present invention.
Figure 10:
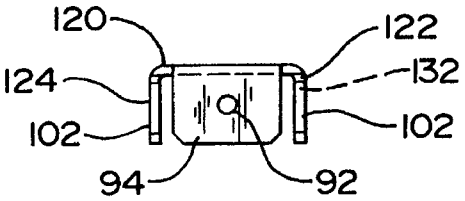
FIG. 10 is an end view of FIG. 9.

A preferred construction for rear cross rail component 34 is shown in FIGS. 9 and 10 to include an upper planar segment 120, a front downturned flange segment 122, a rear downturned flange segment 124, and end segments 94 which are all oriented to be generally orthogonal with respect to each other for defining a open-channelled box-like structure. As noted, bores 92 are formed in end segments 94. Additionally, locking tabs 102 are formed at opposite ends of each of front flange segment 122 and rear flange segment 124 to extend outwardly therefrom and be coplanar therewith. As such, the laterally-spaced pairs of locking tabs 102 are oriented for concurrent receipt within the pair of rear receptor slots 98 formed in each side rail component 30. In a similar fashion, each locking tab 102 is recessed to define a locking channel 130 relative to the exterior surface of each end segment 94.

During assembly on base assembly 14, once locking tabs 102 have been completely inserted into rear receptor slots 98, rear cross rail component 34 is pushed down for causing locking channel 130 to entrap opposite faces of interior leg 62 therein. As such, locking flanges 102 are retained within open-channel 68 of rear side rail component 30 and bores 92 in end segments 94 are precisely aligned with rear bores 90 in side rail components 30 for subsequent insertion of a suitable fastener. To again ensure precise alignment of the mounting bores 92 formed in end segments 94 of rear cross rail component 34 with bores 90 in side rail components 30, a stopping arrangement is provided in association with each locking channel 130 and is formed adjacent to locking tabs 102. More specifically, the length of each locking channel 130 is selected to provide a stop surface 132 which will abut a lower edge surface 134 of rear receptor slots 98 upon rear cross rail component 34 being pushed down after insertion of locking tabs 102 into slots 98. As mentioned, such engagement will provide means for precisely aligning the bores for subsequent receipt of threaded fasteners 77.

It will be appreciated that the above-noted socket-type alignment and locking arrangement results in precise, repetitive assembly of the modular components with a minimum of effort and without the necessity of secondary adhesive and clamping steps. A single fastener 77 is required to secure each end of cross rail components 32 and 34 to each lateral side rail component 30, whereby a total of only four fasteners is required to secure the components into a rigid structural non-wooden base assembly 14. It will be further appreciated that front rail component 32 could also be fabricated to include a pair of laterally-spaced locking tabs at each distal end thereof (i.e., on each end of front flange segment 106 and rear flange segment 108) with a corresponding pair of front receptor slots 92 formed in side rail components 30 if considered necessary.

From the foregoing description it should be appreciated that a wide variety of modifications may be made to the non-wooden base assembly to suit specific platform-type chair applications. Thus, skilled practitioners will recognize that the present invention can be implemented in a variety of forms. Accordingly, while the above description constitutes the preferred embodiment of the present invention, it will be appreciated that the present invention is susceptible to modification, variation and change without departing from the proper scope and fair meaning of the accompanying claims.

What is claimed is:

1. In a motion chair having an upholstered chair frame supported for movement on a base assembly, said base assembly comprising:

a pair of laterally-spaced side rails each having a sidewall portion with a front and rear slot formed in said sidewall portion and each of said side rail being of a one piece construction;

a front cross rail having an end portion at each end thereof and a transverse flange portion including first tab means extending outwardly beyond said end portions, Said first tab means adapted for receipt within said front slots of said laterally-spaced side rails;

a rear cross rail having an end portion at each end thereof and a transverse flange portion including second tab means extending outwardly beyond said end portions, said second tab means adapted for receipt within said rear slots of said laterally-spaced side rails;

said front and rear cross rails each being of a one piece construction and being disposed between said laterally-spaced side rails such that said end portions abut said sidewall portions; and locking means for lockingly retaining each of said first and second tab means within their respective front and rear slots.

2. The chair of claim 1 wherein said side rails and said front and rear cross rails are non-wooden components which can be assembled to define a non-wooden base assembly.

3. The chair of claim 2 wherein each of said non-wooden rails is a stamped metal component.

4. The chair of claim 1 wherein each of said side rails includes a front mounting bore located in proximity to said front slot and a rear mounting bore located in proximity to said rear slot, and wherein said front cross rail includes a pair of mounting apertures that are aligned with said front mounting bores upon locked engagement of said first tab means within said front slots, and wherein said rear cross rail includes a pair of mounting apertures that are aligned with said rear mounting bores upon locked engagement of said second tab means within said rear slots, said base assembly further comprising fastener means received within said aligned mounting bores and apertures for securing said front and rear cross rails to said side rails.

5. The chair of claim 4 wherein each of said side rails is an elongated, generally U-shaped member having an open channel defined by an exterior leg, an interior leg, and an upper web portion interconnecting said exterior and interior legs, and wherein said front and rear slots and said front and rear mounting bores are formed in said interior leg of said side rail.

6. The chair of claim 5 wherein said base assembly further comprises a front glide that is fitted within a forward portion of said open channel and extends outwardly therefrom to define pad surfaces for enclosing a forward end portion of said side rail, said front glide includes a bore formed in a side wall portion thereof which is adapted for alignment with said front mounting bore of said side rail upon installation of said front glide within said open channel.

7. The chair of claim 6 wherein following assembly of said front cross rail to said laterally-spaced side rails via insertion of said first tab means into said front slots, said fastener means is driven through said mounting aperture formed in an end segment of said front cross rail, said front mounting bore in said interior leg of said side rail and said front glide bore to secure the components together in a rigid fashion.

8. The chair of claim 6 wherein said base assembly further comprises a rear glide that is fitted within said open channel at a rearward portion thereof for enclosing a rearward end portion of said side rail, said rear glide having a bore formed in a sidewall portion thereof adapted for alignment with said rear mounting bore of said side rail upon installation of said rear glide within said open channel, and wherein said fastener means is driven through said rear glide bore and said rear mounting bore for fixedly securing said rear glide to said side rail.

9. The chair of claim 5 wherein each of said side rails includes a pair of said rear slots that are formed through said interior leg, said rear slots being sized and oriented to receive said second tab means which include a pair of rear locking tabs formed on each end of said rear cross rail, and wherein said front slot is oriented and sized to receive said first tab means which includes a front locking tab formed on each end of said front cross rail.

10. The chair of claim 9 wherein following assembly of said rear cross rail to said laterally-spaced side rails via insertion of said pair of rear locking tabs into said pair of rear slots, said fastener means are driven through said mounting apertures formed in an end segment of said rear cross rail and said rear mounting bores in said interior legs of said side rails for securing said rear cross rail to each of said side rails.

11. The chair of claim 5 wherein said front cross rail is elongated and generally rectangular in shape and includes an upper planar segment, a front flange segment, a rear flange segment, and a pair of end segments in which said mounting apertures are formed, and wherein each of said front and rear flange segments and said end segments are formed to be orthogonally oriented relative to each other for defining an open-channelled box-like rail structure.

12. The chair of claim 11 wherein said first tab means is a pair of opposed locking tabs that extend outwardly from said front flange segment and are coplanar therewith, each of said locking tabs includes a locking channel.

13. The chair of claim 12 wherein upon insertion of said locking tabs into a corresponding front slot formed in said side rails, said front cross rail is urged downwardly such that said locking channel snugly surrounds the opposite faces of said interior leg of said side rail with said locking tabs being retained within said open channel.

14. The chair of claim 13 further comprising means for aligning said mounting apertures formed in said end segments of said front cross rail with respect to said front mounting bores in said side rails, said alignment means being associated with said locking channels.

15. The chair of claim 14 wherein said alignment means includes a stop surface formed at the terminal end of said locking channel which is engageable with a lower edge surface of said front slot upon said front cross rail being pushed down following insertion of each locking tab into its corresponding front slot.

16. The chair of claim 5 wherein said rear cross rail includes an upper planar segment, a front flange segment, a rear flange segment, and a pair of end segments which are all oriented to be generally orthogonal with respect to each other for defining a open-channelled box-like structure with said mounting apertures being formed in said end segments, and said second tab means comprising locking tabs formed at opposite ends of each of said front flange segment and said rear flange segment, said locking tabs extend outwardly from and are coplanar with said front and rear flange segments.

17. The chair of claim 16 wherein upon insertion of each of said locking tabs into its corresponding front slot formed in said side rail, said front cross rail is pushed down such that said locking channel snugly surrounds the opposite faces of said interior leg of said side rail with said locking tabs retained thereby within said open channel.

18. The chair of claim 17 further comprising alignment means for aligning said mounting apertures formed in said end segments of said front cross rail with respect to said front mounting bores in said side rails, said alignment means being associated with said locking channels.

19. The chair of claim 18 wherein said alignment means includes sizing the length of said locking channels to provide a stop surface which will abut a lower edge surface of said front slot upon said front cross rail being pushed down following insertion of each locking tab into its corresponding front slot.

20. In a motion chair having an upholstered chair frame supported for movement on a base assembly, said base assembly comprising:

a pair of laterally-spaced side rails each having a interior and exterior sidewall defining an open channel therebetween, said interior sidewall having a front and rear slot formed therein and each of said side rail being of a one piece construction;

a front cross rail having first tab means adapted for receipt within said front slots in said laterally-spaced side rails;

a rear cross rail having second tab means adapted for receipt within said rear slots in said laterally-spaced side rails each of said front and rear cross rails being of a one piece construction;

locking means for lockingly retaining each of said first and second tab means within their respective front and rear slots; and a glide fitted within each of said open channels and extending outwardly therefrom to define a pad surface for supporting said base assembly on a floor surface.

21. The chair of claim 20 wherein said glide comprises a front glide fitted within each of said open channels and enclosing a forward end portion of each of said side rail.

22. The chair of claim 20 wherein said glide comprises a rear glide fitted within each of said open channels and enclosing a rearward end portion of each of said side rail.

* * * * *